US008303759B2

(12) United States Patent
Baldauf

(10) Patent No.: US 8,303,759 B2
(45) Date of Patent: Nov. 6, 2012

(54) METHOD FOR THE PRODUCTION OF A LAMINATE MATERIAL FOR HOOK AND LOOP CLOSURES

(75) Inventor: Georg Baldauf, Laer (DE)

(73) Assignee: Mondi Gronau GmbH, Gronau (DE)

( * ) Notice: Subject to any disclaimer, the term of this patent is extended or adjusted under 35 U.S.C. 154(b) by 428 days.

(21) Appl. No.: 11/113,384

(22) Filed: Apr. 22, 2005

(65) Prior Publication Data

US 2006/0180272 A1 Aug. 17, 2006

(30) Foreign Application Priority Data

Feb. 12, 2005 (EP) ..... 05003002

(51) Int. Cl.
*B32B 37/02* (2006.01)

(52) U.S. Cl. ..... 156/290; 156/179; 156/178; 156/180; 156/181; 156/291; 156/292; 428/85; 428/86; 428/92; 428/93; 428/94; 428/95; 428/96; 428/97; 428/196; 428/198

(58) Field of Classification Search ..... 428/100, 428/85, 86, 92–97, 99, 196, 198, 91; 15/179; 156/251, 73, 176, 178, 180, 181, 290–292, 156/229

See application file for complete search history.

(56) References Cited

U.S. PATENT DOCUMENTS

| | | | | | |
|---|---|---|---|---|---|
| 2,153,351 | A | * | 4/1939 | Steinberger | 428/193 |
| 3,950,582 | A | * | 4/1976 | Keuchel | 428/85 |
| 4,782,988 | A | * | 11/1988 | Nishiyama | 226/52 |
| 5,326,612 | A | * | 7/1994 | Goulait | 428/100 |
| 5,595,567 | A | * | 1/1997 | King et al. | 604/391 |
| 5,736,214 | A | | 4/1998 | Billarant | |
| 5,763,041 | A | * | 6/1998 | Leak et al. | 428/100 |
| 6,162,522 | A | * | 12/2000 | Deka et al. | 428/99 |
| 6,216,496 | B1 | * | 4/2001 | Gehring | 66/191 |
| 6,601,265 | B1 | * | 8/2003 | Burlington | 15/319 |
| 2003/0068464 | A1 | * | 4/2003 | Hendrik Brorens et al. | 428/88 |
| 2003/0125704 | A1 | * | 7/2003 | Koele et al. | 604/391 |

FOREIGN PATENT DOCUMENTS

| | | | |
|---|---|---|---|
| DE | 4035519 | * | 5/1991 |
| EP | 0 777 006 | | 6/1997 |
| WO | WO 99/63852 | * | 12/1999 |

OTHER PUBLICATIONS

English translation of the abstract of DE4035519.*

* cited by examiner

*Primary Examiner* — Christopher Schatz
(74) *Attorney, Agent, or Firm* — Collard & Roe, P.C.

(57) ABSTRACT

A method for the production of a laminate material for hook and loop closures, particularly for diaper closures, comprises laminating a textile material onto a carrier film having a surface structure that is suitable for forming a connection with the hooks of a hook and loop closure. The textile material is not connected with the carrier film over its entire area, and the textile material forming the cover layer of the laminate material is brushed after lamination.

15 Claims, 3 Drawing Sheets

METHOD FOR THE PRODUCTION OF A LAMINATE MATERIAL FOR HOOK AND LOOP CLOSURES

BACKGROUND OF THE INVENTION

1. Field of the Invention

The invention relates to a method for the production of a laminate material for hook and loop closures, particularly for diaper closures, wherein a textile material is laminated onto a carrier film having a surface structure that is suitable for forming a connection with the hooks of a hook and loop closure.

2. The Prior Art

The laminate material produced according to the method forms the female part of a hook and loop closure. When used on a diaper, a strip of the laminate material, which is applied to the front waistband region of the diaper, and a closure tape, which is attached at the side of the diaper, form a hook and loop closure. Hook and loop closures can be opened and closed multiple times and are less sensitive to contact with skin creams or powder, as compared with adhesive closures.

Various demands are made on the laminate material for hook and loop closures on baby diapers. It is supposed to have a soft surface, in order to prevent skin irritations when it makes contact with the baby's skin. The textile substrate is supposed to have as low a weight per area unit as possible, so that it can be produced inexpensively and is translucent, so that the surface of the carrier film, which is generally imprinted, remains visible. In order to fulfill its function as a hook and loop closure, the laminate material must have enough fibers on which the hook and loop hooks can anchor themselves.

A method for the production of a laminate material this purpose is described in European Patent No. EP 0 777 006 B1. In this connection, the textile material consists of an interlaid scrim of warp and weft threads and loops connected with the interlaid scrim using knitting technology. For a permanent bond, the textile material is laminated onto the carrier film with a sufficiently thick layer of adhesive. Both the smoothing of the surface in the lamination process and the gluing of fibers results in a reduction in the number of effective fibers on which the hook and loop hooks can anchor themselves, and this results in a deterioration of the hook and loop properties of the laminate material.

SUMMARY OF THE INVENTION

It is therefore an object of the invention to provide a method for the production of a laminate material for hook and loop closures, which leads to an improvement in the hook and loop properties of the laminate material, as compared with the state of the art, at a high laminate strength of the laminate material.

This object is accomplished in that the textile material is not connected with the carrier film over its entire area, and the textile material forming the cover layer of the laminate material is brushed after lamination. The carrier film and the textile material are preferably glued to one another, whereby the adhesive is applied to the carrier film not over its entire surface, but in a pattern consisting of adhesive areas and regions that are free of adhesive. The carrier film, with the adhesive applied to it, and the textile material pass through a pair of rollers in which the carrier film is pressed together with the textile material.

The adhesive is preferably applied to the carrier film in accordance with a pattern that has fields having an adhesive pattern of adhesive areas and regions that are free of adhesive, and having field frames consisting of an adhesive film applied over an entire area. The adhesive can be applied to the carrier film, in the fields, in the form of dots, in a pattern of parallel or intersecting stripes, in a pattern having a cell-shaped structure, or a combination of these patterns. The adhesive-covered area amounts to 20% to 80%, preferably 40% to 60% of the total area of the laminate material. The field frames, which consist of an uninterrupted, full-area adhesive film, are disposed in such a manner that the textile material and the carrier film have a complete, surrounding, non-positive lock glue connection at the edges of the pieces obtained from the web of laminate material, which form the female part of a hook and loop closure. Fraying of the textile material, or even tearing of the textile material from the carrier film at the edge of a piece of laminate material, where the greatest forces occur when the hook and loop closure is opened and the open ends of the textile material are present can be prevented by means of the adhesive frame. The adhesive areas that surround the fields having an adhesive pattern furthermore result in less dust formation when the laminate material web is cut. Since the cut always takes place in the zones that have been glued over their entire area, no loose fiber residues and filament residues, which could contaminate the system as dust, occur. The good hook and loop effect between the textile material and the hook and loop hooks is guaranteed in the non-glued regions. Therefore an amount of adhesive that guarantees a reliable and permanent bond between the textile material and the carrier film can be applied at the glued regions. Local gluing of the fibers and a reduction in the hook and loop effect in these regions can be tolerated because of the good hook and loop properties in the non-glued regions.

In a preferred embodiment of the method, the adhesive is applied to the carrier film using a rotary printing method. The carrier film passes through a printing roller arrangement consisting of an engraved cylinder and a counter-cylinder that presses the film against the engraved cylinder, whereby the surface of the engraved cylinder is provided with an engraving that corresponds to the adhesive pattern. An adhesive film is applied to the surface of the engraved cylinder or the surface of the counter-cylinder, which film is transferred to the carrier film at the raised areas of the engraving.

Brushing of the textile cover layer of the laminate material results in an improvement in the hook and loop properties, and in a softer surface of the textile material, whereby different effects of the brushing process, which are dependent on the type of the textile material and on the brush being used, and will be described below, can contribute to improved hook and loop properties. By means of the brushing process, the non-glued regions of the textile cover layer are particularly affected and deflected, and part of the textile yarns is split into its fibers. In the case of nonwoven fabrics, individual long fibers are additionally released from the laminate, thereby resulting in loops and fiber ends on which the hook and loop hooks can anchor themselves. The textile layer becomes softer and more voluminous, both when using a woven textile and when using a warp-knit fabric, and the number of fibers on which the hook and loop hooks can anchor themselves is increased. In the case of a nonwoven fabric, a significant hook and loop property of the textile cover layer is only produced by the brushing process.

The brushing process can be carried out with brush rollers. It is practical if the rotation of the brush rollers is established so that the surface of the brush has a positive or negative relative speed with regard to the laminate material web that passes underneath the brush roller. By rotating the brush roller in the plane parallel to the laminate material web that passes underneath, and by changing the speed of rotation of the brush roller, the brushing direction and the brushing speed can be varied, with regard to the laminate material web passing through. This is important, among other things, since different results can be expected, as a function of the brushing direction, due to the type of fabric, for example the alignment of the fibers in a nonwoven fabric, and as a result of the processing direction of the laminate material web.

The tensile force perpendicular to the plane of the laminate material web can be influenced by using brushes that are aligned at a slant or bent. During the rotation of the brush rollers, the fibers are thereby pulled away from the laminate material web, as a function of the orientation of the bristles. In order to improve the brushing process, the process can also be carried out in several steps, with different brushes and/or with different brushing directions and speeds, according to the invention, whereby the different effects of the individual brushing processes can be combined. Aside from this, fixed brushes can be used for the brushing process, alternatively or in addition. The bristles of the brushes consist of metal and/or plastic.

Reference marks imprinted on the carrier film, which mark the positioning of the adhesive frames, can facilitate the further processing of the laminate material web.

According to a preferred embodiment, a textile material of woven textile, a material having a basic interlaid scrim consisting of filament yarn and having loops that are connected with the basic interlaid scrim by means of knitting technology, or a nonwoven fabric having a weight per area unit between 5 g/m$^2$ and 60 g/m$^2$ is laminated onto a carrier film of polyethylene, polypropylene, polyester, polyamide, or a mixture or a copolymerizate of these polymers, having a weight per area unit between 5 g/m$^2$ and 50 g/m$^2$. Preferred adhesives are hot-melt glues on the basis of PAO, EVA, SBS, SIS, reactive polyurethane adhesives, acrylate adhesives, as well as radiation-curing adhesives.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
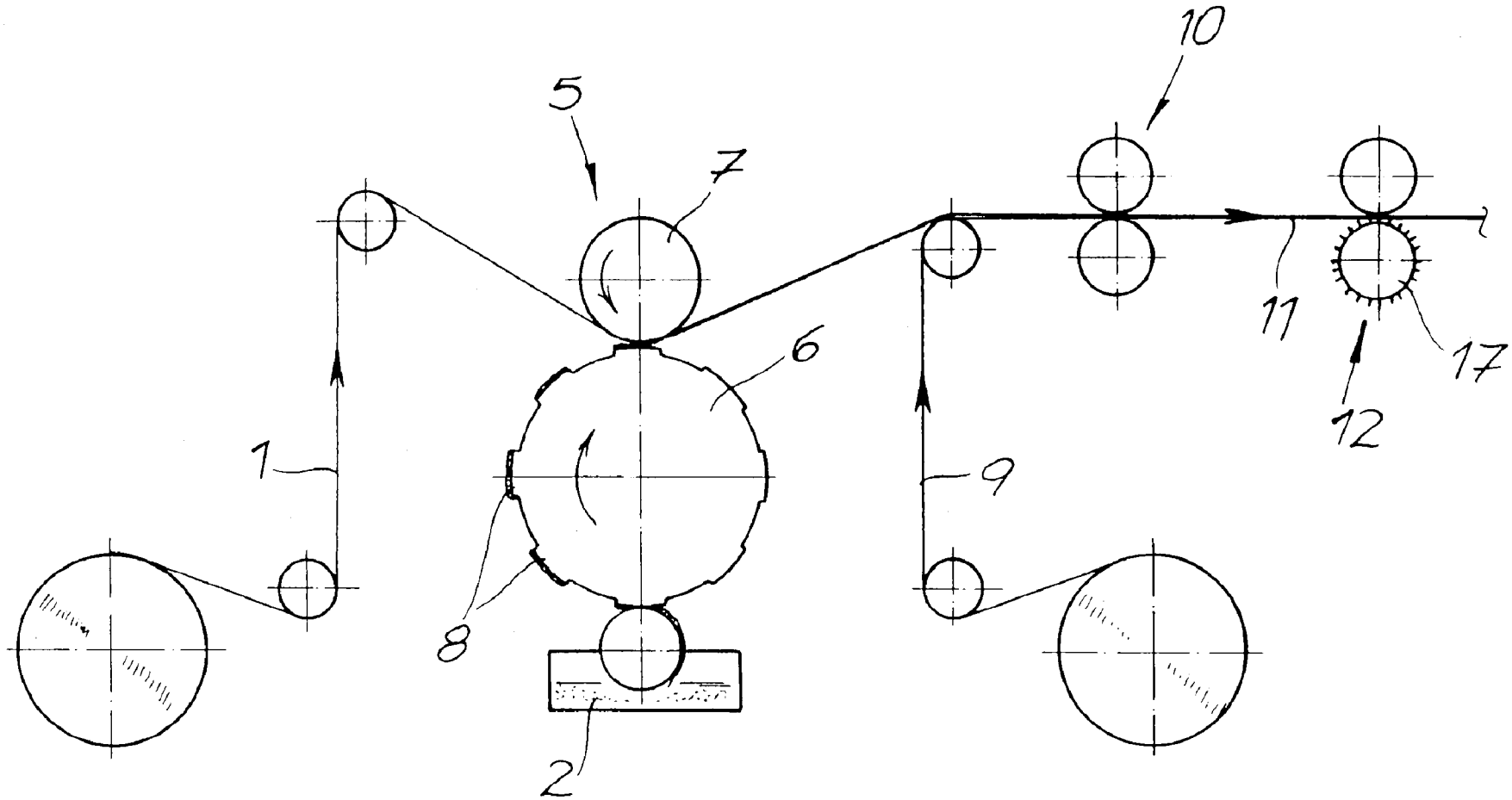
FIG. 1 shows a system for the production of the laminate material.

The method for the production of the laminate material is schematically shown in FIG. 1. Adhesive 2 is applied to a carrier film 1 in a pattern consisting of adhesive areas 3 and regions 4 that are free of adhesive. The adhesive is applied to carrier film 1 according to a rotary printing method, for example. In this connection, carrier film 1 passes through an arrangement of printing rollers 5, consisting of an engraved cylinder 6 and a counter-cylinder 7 that presses carrier film 1 against the engraved cylinder. The surface of engraved cylinder 6 is provided with an engraving 8 that forms the adhesive pattern. In the embodiment of the method as shown, an amount of adhesive that can be determined in a variable manner is applied to the surface of engraved cylinder 6, and transferred to carrier film 1 at the elevated surfaces of engraving 8. A material web of a textile material 9, which is suitable for forming a connection with hook and loop hooks, is applied to the side of carrier film 1 that is provided with adhesive 2. The two-layer web that is formed as a result runs through the roller nip of a pair of rollers 10, in which carrier film 1 is pressed together with textile material 9, to form a laminate material 11. Subsequently, the textile cover layer of the laminate material 11 is brushed with a brush arrangement 12.

For the method shown, carrier films 1 of polyolefins, polyester, polyamide, mixtures or copolymerizates of these polymers can be used. The textile material preferably has a weight per area unit between 5 g/m$^2$ and 60 g/m$^2$, and can consist of a woven textile, a material having a basic interlaid scrim consisting of filament yarn and having loops that are connected with the basic interlaid scrim by means of knitting technology, or a nonwoven fabric. To glue carrier film 1 to textile material 9, hot-melt glues on the basis of PAO, EVA, SBS, SIS, reactive polyurethane adhesives, acrylate adhesives, as well as radiation-curing adhesives can be used.

Figure 2:
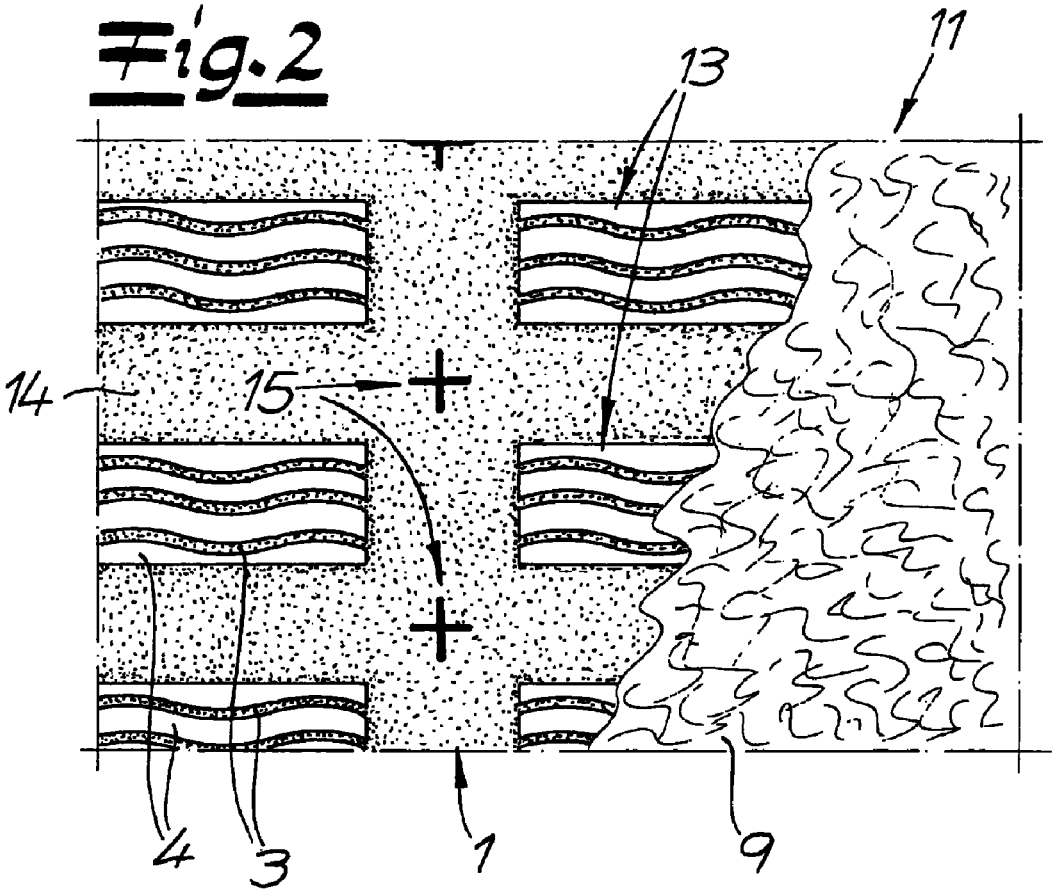
FIG. 2 shows a top view of a detail of a laminate material, which was produced in a method according to FIG. 1.

FIG. 2 shows a top view of the layer structure of laminate material 11. The drawing shows that adhesive 2 is applied to carrier film 1 in accordance with a pattern, which has fields 13 having an adhesive pattern of adhesive areas 3 and regions 4 that are free of adhesive, and having field frames 14 of an adhesive film applied over the entire area. In fields 13, adhesive 2 can be applied to carrier film 1 in the form of dots, in a pattern of parallel or intersecting stripes, in a pattern having a cell-shaped structure, or a combination of these patterns. The proportion of the adhesive-covered area within the fields amounts to 20% to 80%, preferably 40% to 60%. The field frames 14, which consist of an uninterrupted adhesive film, form the edges of the pieces cut off from the web of laminate material, which form hook and loop closures together with hook tapes. Reference marks 15 that are visible or can be seen only under UV light mark the positions of the field frames 14 that are configured as an adhesive area. At regions 4 that are free of adhesive, where the textile material 9 is not glued to carrier film 1, the laminate material has a good hook and loop effect.

Figure 3:
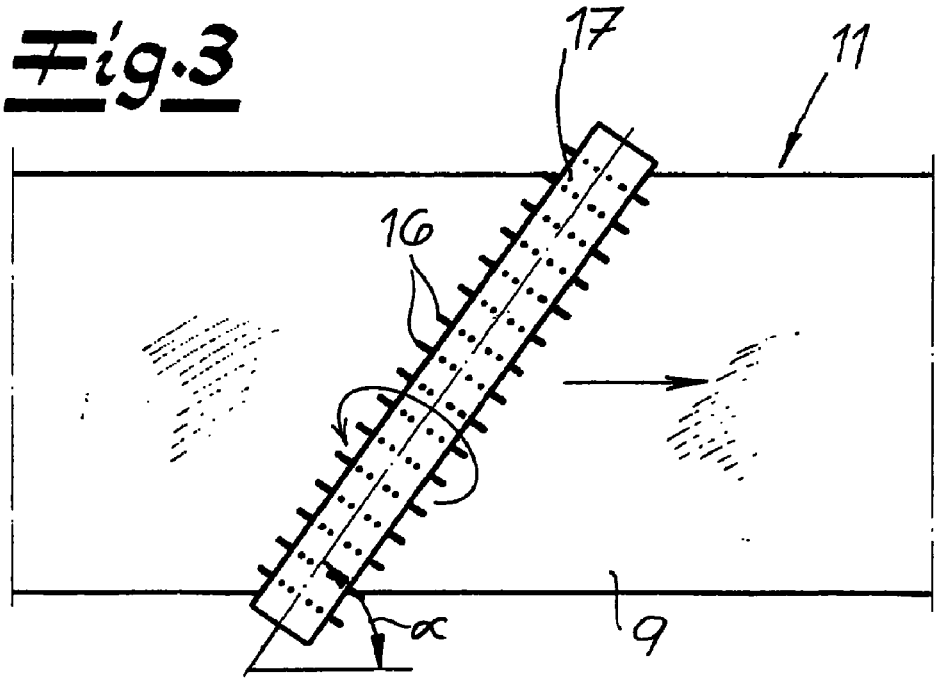
FIG. 3 shows a top view of a brush roller with the laminate material web passing underneath it.

A clear improvement in the hook and loop properties can be achieved by means of a subsequent brushing process, shown in FIG. 3. In the method step shown, bristles 16, which consist of metal or plastic, for example, are disposed on a driven brush roller 17. Brush roller 17, as shown in FIG. 3, can be pivoted in a plane parallel to laminate material web 11. By varying the pivot angle $\alpha$ and/or the speed of rotation of brush roller 17, both the brushing direction and the brushing speed, i.e. the relative speed between the brush surface and laminate material web 11, can be adjusted. It also lies within the scope of the invention that two or more different brush rollers 17 and/or fixed brushes are used, one after the other.

Figure 4:
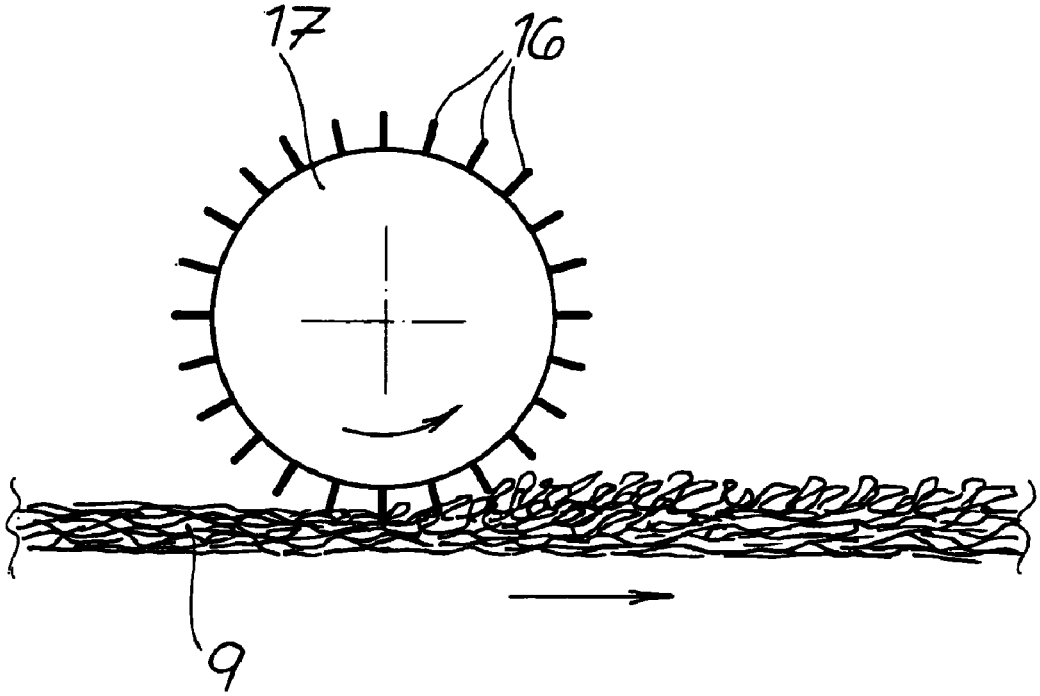
FIG. 4 shows a cross-section through a brush roller with the textile substrate lying underneath it.

FIG. 4 shows, in cross-section, the process of brushing textile material 9 that forms the cover layer of the laminate material. The bristles 16 of brush roller 17 engage textile material 9 at the non-glued regions of laminate material 11. At a relative speed between the laminate material web and brush roller 17, individual fibers are seized and deflected by the bristles 16. Individual yarns of the textile material can also be broken into their fibers. The textile cover layer of laminate material 11 becomes more voluminous and softer as a result.

The number of loops and of fiber ends that project at a slant from the material, on which the hook and loop hooks can anchor themselves, is increased.

Figure 5:
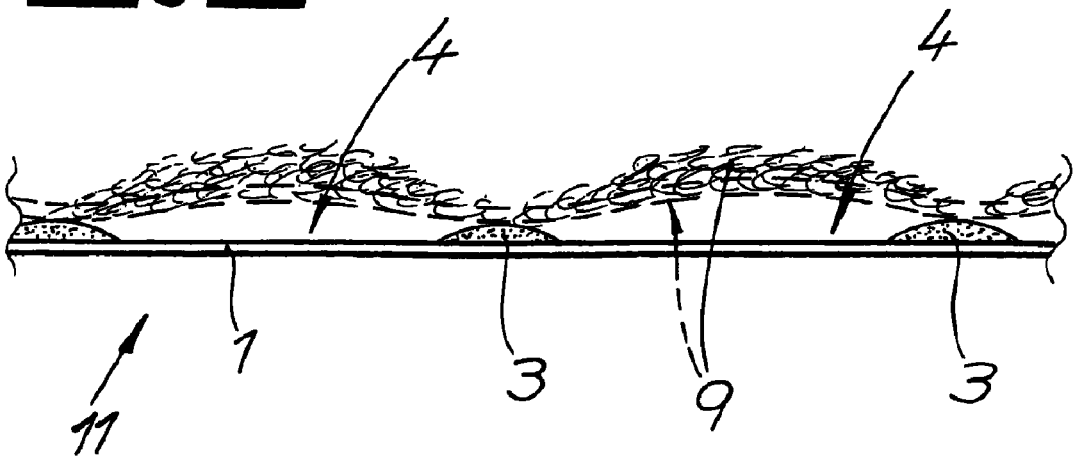
FIG. 5 shows the laminate material after the brushing process.

The change in textile material 9 that forms the cover layer is shown schematically in FIG. 5. The contour of the unbrushed material has been shown with a broken line, for a comparison. By means of the brushing process, textile material 9 is greatly built up in the regions free of adhesive, thereby becoming more voluminous and softer. If a suitable brush arrangement 12 is selected, the bond between the textile material and carrier film 1 is not significantly impaired in the glued regions. In coordination with the type of textile material 9, the brushing process can be optimized by varying the hardness of bristles 16, changing the brushing direction and speed, and/or using bristles 16 that run at a slant or are bent.

Accordingly, while only a few embodiments of the present invention have been shown and described, it is obvious that many changes and modifications may be made thereunto without departing from the spirit and scope of the invention.

What is claimed is:

1. A method for the production of a laminate material for hook and loop closures, comprising the following steps:

laminating a textile material onto a carrier film via an adhesive, continuously passing the laminate material to a brush arrangement without winding the laminate material onto a take-up roll;

brushing the textile material after said step of laminating;

wherein the adhesive is applied to the carrier film in a pattern that has fields having adhesive areas and regions that are free of adhesive, and having field frames comprising an adhesive film applied over an entire area, and forming separate pieces from the laminate material, wherein the field frames are disposed in such a manner that the textile material and the carrier film have a complete surrounding glue connection at edges of the pieces obtained from the laminate material, said pieces forming female parts of hook and loop closures, wherein the brushing step is accomplished by means of at least one brush roller, wherein a surface of the brush roller moves at a positive or negative relative speed with regard to a speed of the laminate material that passes underneath the brush roller wherein by means of the brushing step the textile material in the non-glued regions of the laminate material are affected and deflected resulting in an improvement of the hook and loop properties of the laminate material, whereby some yarns that comprise textile material are split into fibers.

2. A method according to claim 1, wherein the carrier film, adhesive and the textile material pass through a pair of rollers in which the carrier film is pressed together with the textile material.

3. A method according to claim 1, wherein the adhesive is applied to the carrier film using a rotary printing method.

4. A method according to claim 1, wherein the adhesive is applied to the carrier film, in the fields, in one or more of the following patterns: dots, parallel stripes, intersecting stripes, or a cell-shaped structure.

5. A method according to claim 1, wherein reference marks that are visible or can be seen only under UV light are imprinted on the carrier film to mark the fields.

6. A method according to claim 1, wherein the textile material has a weight per area unit between 5 $g/m^2$ and 60 $g/m^2$.

7. The method according to claim 1, wherein the proportion of the adhesive-covered area within in the fields amount to 40% to 60%.

8. A method according to claim 1, wherein said step of brushing is accomplished with at least one brush having bristles made of metal or plastic, in one or more work steps.

9. A method according to claim 8, wherein said at least one brush has bristles that are disposed at a slant on the brush surface, or are bent.

10. A method as in claim 8, wherein the brushing step further comprises using at least one fixed brush.

11. The method as in claim 10, wherein said at least one brush is pivoted at an angle offset relative to a direction of movement of the textile material.

12. The method as in claim 1, wherein said step of brushing causes said textile material to become more voluminous.

13. A method according to claim 2, wherein said step of brushing is accomplished with at least one brush having bristles made of metal or plastic, in one or more work steps.

14. A method according to claim 13, wherein said at least one brush has bristles that are disposed at a slant on the brush surface, or are bent.

15. A method as in claim 13, wherein the brushing step further comprises using at least one fixed brush.

* * * * *